US010730091B2

(12) United States Patent
Zermatten et al.

(10) Patent No.: US 10,730,091 B2
(45) Date of Patent: Aug. 4, 2020

(54) TOOL FOR A PRESS BRAKE

(71) Applicant: Henri Emil Louis Maurice Zermatten, Johannesburg (ZA)

(72) Inventors: Henri Emil Louis Maurice Zermatten, Johannesburg (ZA); Dieter Henri Zermatten, Johannesburg (ZA)

(73) Assignee: Henri Emil Louis Maurice Zermatten, Johannesburg (ZA)

( * ) Notice: Subject to any disclaimer, the term of this patent is extended or adjusted under 35 U.S.C. 154(b) by 225 days.

(21) Appl. No.: 15/752,833

(22) PCT Filed: Aug. 4, 2016

(86) PCT No.: PCT/ZA2016/000020
§ 371 (c)(1),
(2) Date: Feb. 14, 2018

(87) PCT Pub. No.: WO2017/031509
PCT Pub. Date: Feb. 23, 2017

(65) Prior Publication Data

US 2018/0236517 A1 Aug. 23, 2018

(30) Foreign Application Priority Data

Aug. 14, 2015 (ZA) ..... 2015/05884

(51) Int. Cl.
*B21D 5/02* (2006.01)

(52) U.S. Cl.
CPC ..... *B21D 5/0227* (2013.01); *B21D 5/0209* (2013.01)

(58) Field of Classification Search
CPC ..... B21D 5/02; B21D 5/0209; B21D 5/0227; B21D 5/0236; B21D 5/0254; B21D 37/02; B21D 37/04
See application file for complete search history.

(56) References Cited

U.S. PATENT DOCUMENTS 5,022,248 A 6/1991 Brooks et al.
5,249,452 A 10/1993 Baldwin et al.
(Continued)

FOREIGN PATENT DOCUMENTS

CH 680772 11/1992
CN 203919808 * 6/2014
(Continued)

OTHER PUBLICATIONS

Translation of CN 203919808. Author: He. Translated Nov. 2019 (Year: 2014).*
(Continued)

*Primary Examiner* — Adam J Eiseman
*Assistant Examiner* — Matthew Kresse
(74) *Attorney, Agent, or Firm* — Haugen Law Firm PLLP

(57) ABSTRACT

This invention relates to a tool for press brake. More specifically, the invention relates to a modular and adjustable female die tool mountable to a stationary bed part of a press brake machine or similar. The modular die tool unit (10) includes a drive shaft (18) rotatable about a central longitudinal axis, a pair of first and second die jaws (14, 16) each located on opposite sides of the longitudinal axis and reciprocally movable towards and away from on another relative to such longitudinal axis, and a connecting formation at each of the longitudinal ends of the drive shaft (18) for: (i) coaxially connecting the drive shafts (18) of two or more adjacent modular die tool units (10) end-to-end; and/or (ii) connecting a drive means to the drive shaft (18) of one of the modular die tool units (10) thereby to drive such drive shaft (18) and the other drive shafts (18) connected thereto.

17 Claims, 9 Drawing Sheets

(56) References Cited

U.S. PATENT DOCUMENTS

| | | | | |
|---|---|---|---|---|
| 5,305,659 | A | 4/1994 | Dieperink et al. | |
| 5,366,431 | A | 11/1994 | Smith et al. | |
| 5,564,301 | A | 10/1996 | Roennmark | |
| 6,886,386 | B1 | 5/2005 | Cantrell | |
| 2006/0231981 | A1 | 10/2006 | Lee et al. | |
| 2009/0123588 | A1 | 5/2009 | Lee et al. | |
| 2010/0303537 | A1* | 12/2010 | Brown | F16D 1/101 403/14 |
| 2012/0291577 | A1* | 11/2012 | Hicks | F16H 57/02 74/411.5 |
| 2016/0017929 | A1* | 1/2016 | Sugiyama | B60K 17/22 464/15 |

FOREIGN PATENT DOCUMENTS

| | | | | |
|---|---|---|---|---|
| DE | 682148 | | 10/1939 | |
| DE | 1085487 | | 7/1960 | |
| DE | 3235775 | | 3/1984 | |
| EP | 0314794 | B1 * | 5/1993 | B29C 45/1742 |
| EP | 1287916 | | 3/2003 | |
| GB | 1448120 | | 9/1976 | |
| SU | 496072 | | 12/1975 | |
| WO | 9718907 | | 5/1997 | |
| WO | 0176784 | | 10/2001 | |

OTHER PUBLICATIONS

Search Report and Written Opinion for international patent application serial No. PCT/ZA2016/000020 dated Nov. 28, 2016.

* cited by examiner

TOOL FOR A PRESS BRAKE

BACKGROUND OF THE INVENTION

This invention relates to a tool for press brake. More specifically, the invention relates to a modular and adjustable female die tool mountable to a stationary bed part of a press brake machine or similar.

Female die tools are well known. Historically, these tools are made from large and heavy blocks of metal having a specific groove cut there into for forming a specifically shaped bend in a metal plate pressed downwardly there upon by a male punch tool mounted on a moving ram of the press brake machine.

Should a different bend be required, an operator would be forced to halt production and change out the tool. With the tools being large and heavy, such tool changes are very dangerous and time consuming, requiring the operator to carefully maneuver the tools on and off of the press brake, typically with overhead cranes. It will be appreciated that this halt in production is very costly to manufacturing facilities.

Attempts have been made to address these problems by, instead of using interchangeable female die tools, introducing a single adjustable female die tool comprising die jaws that are movable relative to one another to the form the required groove there between. Examples of such adjustable female die tools are described in published patents documents U.S. Pat. Nos. 5,249,452, 5,305,659 and WO 01/76784.

Although such adjustable die tools would result in many less tool changes, such adjustable die tools have their own disadvantages. Firstly, they may not provide the capability to form every conceivable bend and as such, will require tool change outs from time-to-time. The adjustable die tools are even heavier than their interchangeable counterparts and accordingly, more dangerous and time consuming to handle.

Secondly, many of these adjustable die tools comprise overly complicated drive means that not only make such die tools expensive, but many require the drive means (or at least the transmissions thereof) to be at least partly disassembled and reassembled during tool changes.

Thirdly, it will be appreciated that press brakes are available in varying sizes and specifically, in varying standard bed lengths. It appears that the known adjustable die tools are made to fit these standard bed lengths and as such, cannot be used in a press brake of a different bed length. This requires manufacturing facilities to purchase different adjustable die tools for each of their press brakes.

Accordingly, it is an object of the present invention to provide a modular female die tool unit that is lighter and easier to handle, comprises adjustable die jaws and is connectable end-to-end with like modular units to cater for varying standard bed lengths of differently sized press brakes.

SUMMARY OF THE INVENTION

According to the invention there is provided a modular die tool unit for a press brake including:

a drive shaft having opposing first and second longitudinal ends and a central longitudinal axis extending there through about which the drive shaft is rotatable;

a pair of first and second die jaws each located on opposite sides of the central longitudinal axis, the die jaws being reciprocally movable towards and away from one another relative to the central longitudinal axis;

a translating means for translating the rotational motion of the drive shaft into the reciprocal motion of the die jaws; and a connecting formation at each of the longitudinal ends of the drive shaft for:

(i) coaxially connecting to adjacent drive shafts of one or more adjacent modular die tool units so as to connect such drive shafts end-to-end; and/or (ii) connecting a drive means to the drive shaft of the modular die tool unit, or to the adjacent drive shaft of the one or more adjacent modular die tool units, thereby to drive rotation of the such drive shafts.

Typically, the drive shaft is divided longitudinally between a first portion, having a left-hand or right-hand thread defined there along, and a second portion, having the other of the left-hand or right-hand thread defined there along, wherein the first portion and the second portion are located nearer the first and the second longitudinal ends of the drive shaft respectively.

In one embodiment, the connecting formation at each of the longitudinal ends of the drive shaft may be a castellated connecting formation, the castellated connecting formations of co-axially connectable drive shafts being engageable directly or through an intermediary member.

In an alternative embodiment, the connecting formation at the first longitudinal end of the drive shaft is a male spline formation and at the second longitudinal end of the drive shaft is a spline hole for receiving the male spline formation of the adjacent drive shaft therein.

In yet another embodiment, the connecting formation at each of the first and the second longitudinal ends of the drive shaft is: (i) a male spline formation; or (ii) a female spline formation; having a coupling connectable respectively thereon or therein for connecting the drive means thereto and/or the drive shafts of adjacent modular die tool units together.

Generally, the coupling is from a group of couplings including:

(i) a sleeve coupling defining at opposing ends thereof spline holes for receiving the male spline formations of the adjacent drive shafts therein;

(ii) a spline-to-spline coupling defining at opposing ends thereof male spline formations insertable into the spline holes of the adjacent drive shafts; and (iii) a cog coupling having thereon either a male spline formation or a spline hole for engaging the drive shaft, and a cog for engaging: (i) the cog on the drive shaft of an adjacent modular die tool unit; and/or (ii) the drive means for rotating the drive shaft.

It will be appreciated that the cog may be a gear and that a gearing set transmits drive: (i) from the drive means to the drive shafts; and/or (ii) between co-axially connected drive shafts of adjacent modular die tool unit.

Preferably, the cog is a sprocket and a transmission chain transmits drive: (i) from the drive means to the drive shafts; and/or (ii) between co-axially connected drive shafts of adjacent modular die tool unit. It will be appreciated that this type of coupling is commonly known in technical terms as a chain coupling.

The translating means may be made up of:

first and second threaded followers located respectively on the first and the second portions for the drive shaft and movable axially there along between a first condition, wherein rotation of the drive shaft in a first direction causes the first and second threaded followers to move towards one another, and a second condition, wherein rotation of the drive shaft in a second direction causes the first and second threaded followers to move away from one another;

a pair of primary connecting arms located on one side of the central longitudinal axis, the primary connecting arms each having a first end pivotally connected to one of the respective first or second threaded followers and a second end pivotally connectable to the first die jaw; and a pair of secondary connecting arms located on a side of the central longitudinal central axis opposite to the side on which the primary connecting arms are located, the secondary connecting arms each having a first end pivotally connected to one of the respective first or second threaded followers and a second end pivotally connectable to the second die jaw;

such that movement of the first and second threaded followers towards the:

(i) first condition, causes the die jaws to move away from one another; and (ii) second condition, causes die jaws to move towards one another;

wherein the movement of the die jaws is transversal to and symmetrical with respect to the central longitudinal axis of the drive shaft.

Generally, the translating means further includes first and second connectors connected between the respective first and second die jaws and the second ends of the primary and secondary connecting arms, the second ends of the primary and secondary connecting arms being pivotally connected to the first and second connectors.

Typically, the first and second connectors are connector blocks pivotally connected to the second ends of the respective connecting arms and fastened to the respective first or second die jaws such that movement of the first and second threaded followers towards the:

(i) first condition, causes the first and second connector blocks, and consequently the first and second die jaws respectively connected thereto, to move away from one another; and (ii) second condition, causes the first and second connector blocks, and consequently the first and second die jaws respectively connected thereto, to move towards from one another.

It will be appreciated that mechanism employed in the translating means described herein operates in a similar manner to the mechanism employed in commonly known scissor-type jacks.

In a preferred embodiment of the invention, the modular die tool unit includes a support bed on which the drive shaft is supported, the support bed and the die jaws having correspondingly engageable sliding formations along which the die jaws are slidable relative to the support bed.

Generally, the correspondingly engageable sliding formations is a plurality of rails projecting outwardly from the support bed or the die jaws, and a plurality of rail grooves defined in the other of the support bed or the die jaws, the rails being receivable and slidable within the rail grooves.

Typically, the support bed is made up of a base member and a cover member mountable over the base member thereby to substantially enclose the drive shaft and the translating means therebetween, the drive shaft being rotatably mountable on the base member on at least a pair of spaced apart bush or bearing mounts.

Preferably, the rails are T-shaped rails projecting outwardly from the cover member of the support bed and the rail grooves are T-shaped rail grooves defined in the die jaws, the T-shaped rails being slidably engageably with the T-shaped rail grooves, and further wherein at least the cover member of the support bed defines slots therein along which the first and second connector blocks are movable and through which such connector blocks are fastenable to the respective first and second die jaws.

More preferably, the support bed houses two drive shafts connected end-to-end with each drive shaft having a translating means such that each of the first and second die jaws is movably supported on two respective first and second connector blocks.

Generally, each die jaw comprises one or more contact inserts along which a work piece to be operably bent by the press brake comes into contact with the modular die tool unit. Typically, the contact inserts are removably fastenable to the die jaws. Preferably, the inserts have a rounded contact end an opposite flat base end.

Furthermore, one or more bracing members are removably fastenable between the die jaws and/or the support beds of adjacent modular die tool units in a staggered fashion. The modular die tool unit may further include one or more friction reducing members positioned between adjacent rails, and sandwiched between the die jaws and the support bed, thereby to reduce the force of friction operably acting between the die jaws and the support bed arising from the relative sliding of the die jaws relative to the support bed.

To make the unit safe, and or to protect certain components from damage or grit, the modular die tool unit also includes a central guard and a pair of flanking guards for covering the rails regardless of the position of the die jaws on the support bed.

The central guard is generally connected across operatively inner sides of the first and the second die jaws, with each of the flanking guards connected across an operatively outer side of the respective first or second die jaw and an operatively outer side of the support bed.

Generally, the guards are flexible. Typically, the guards are resilient. Preferably, the guards are leather having at least one side soaked in polyurethane.

BRIEF DESCRIPTION OF THE DRAWINGS

The invention will now be described in more detail, by way of example only, with reference to the accompanying drawings in which.

DETAILED DESCRIPTION OF THE DRAWINGS

Figure 1:
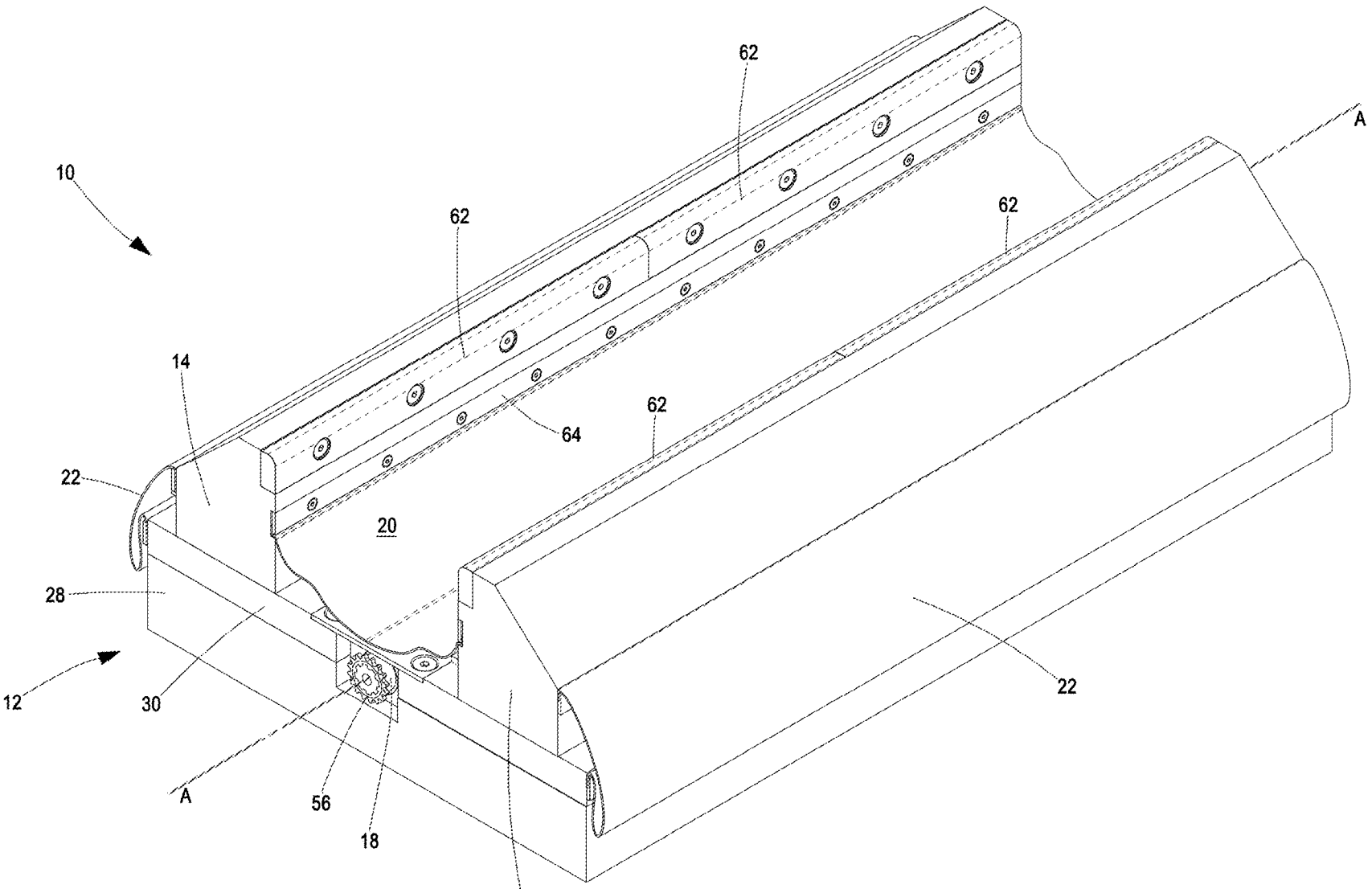
FIG. 1 is a perspective view of a modular die tool unit in accordance with the present invention in a fully assembled form.
Figure 2:
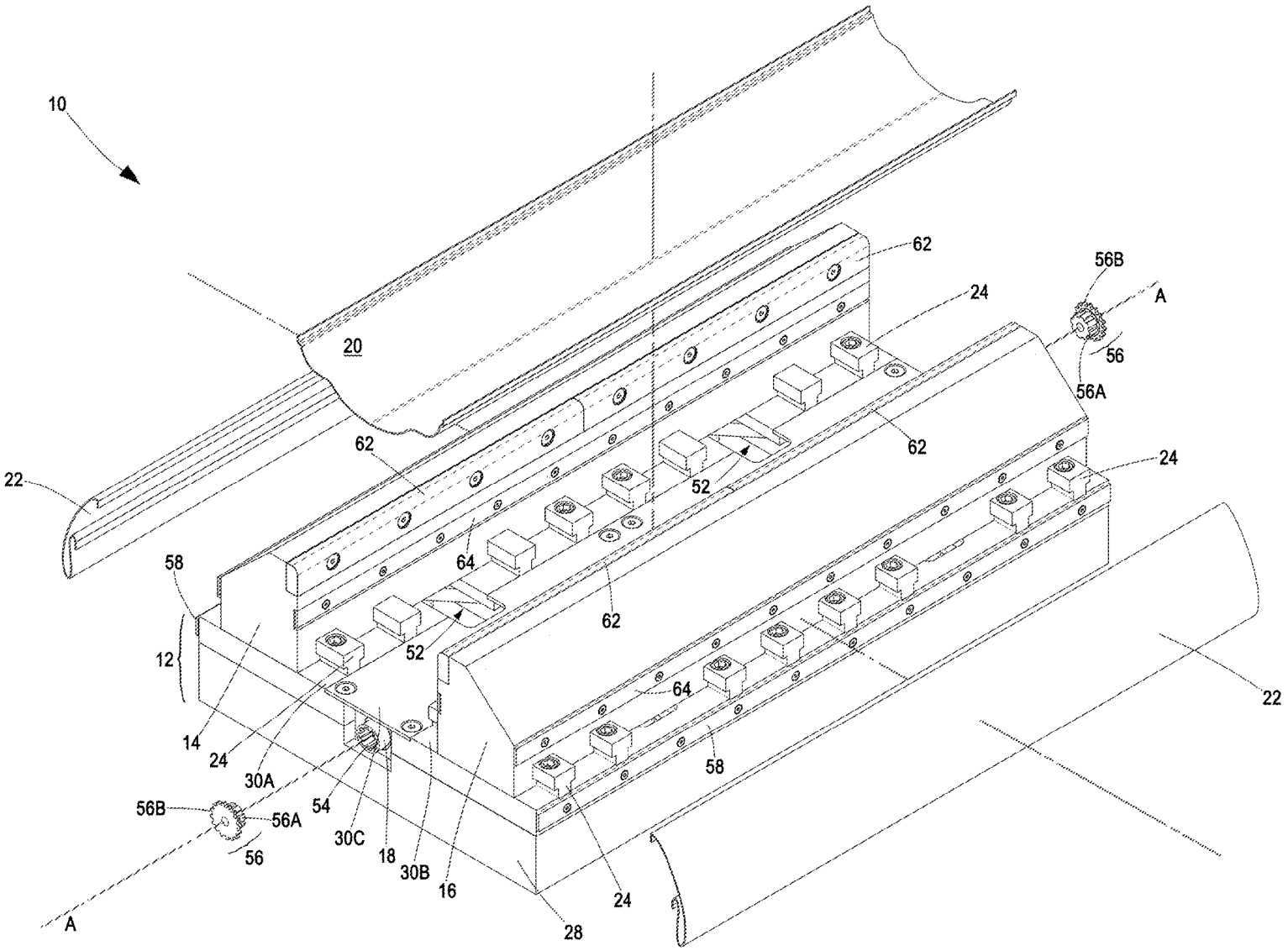
FIG. 2 is a perspective view of the modular die tool unit of FIG. 1 with central and flanking resilient guards exploded therefrom.

A modular die tool unit for a press brake machine (not shown) according to a preferred embodiment of the invention is designated generally with reference numeral 10 in FIG. 1 and FIG. 2.

The modular die tool unit 10 comprises a support bed 12, a pair of first and second die jaws 14, 16, a drive shaft 18, as well as a central and a pair of flanking resilient guards 20, 22 for protecting a plurality of sliding rails 24 projecting from the support bed 12 from contact and/or grit and grime.

Figure 3:
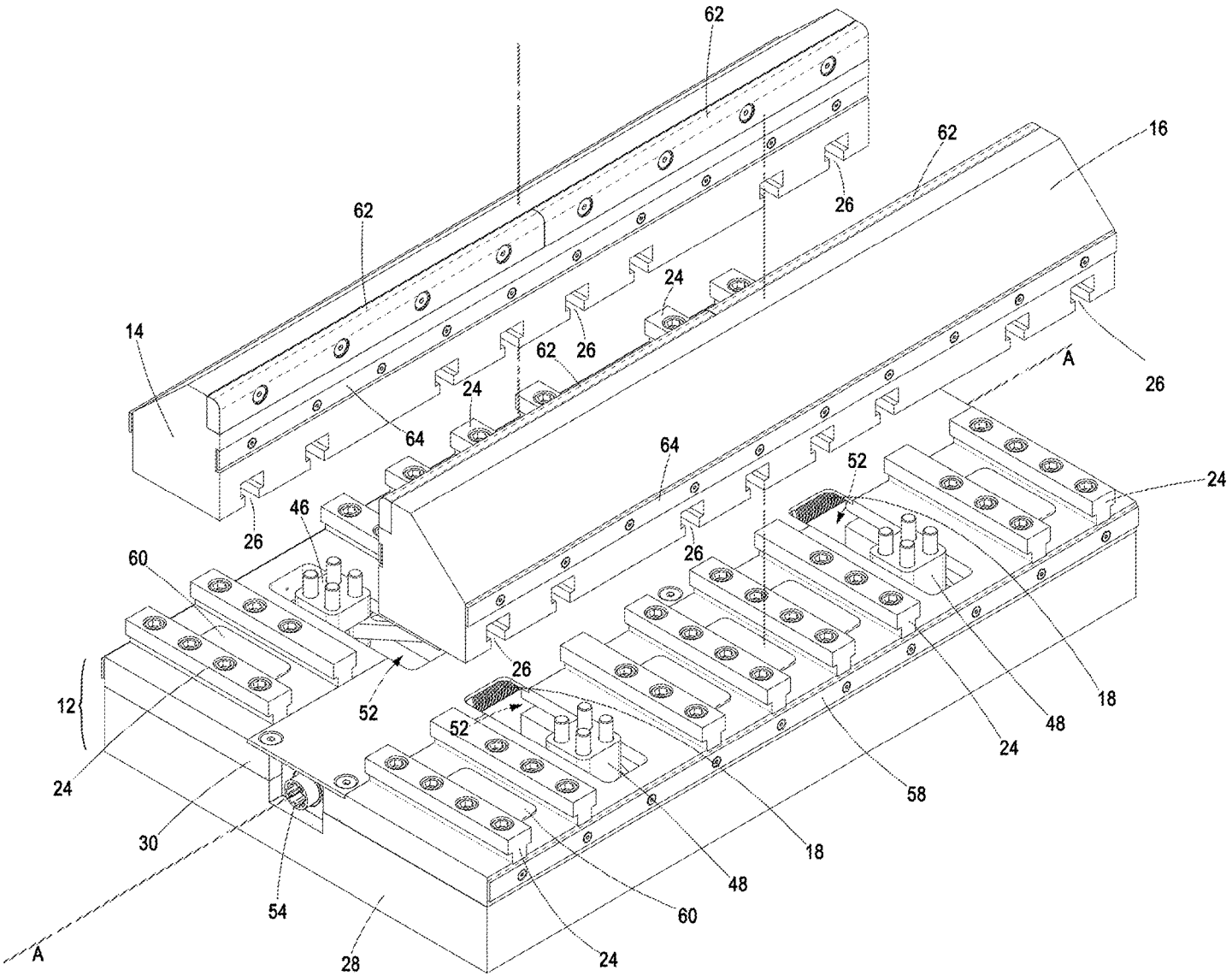
FIG. 3 is a perspective view of the modular die tool unit of FIG. 1 with the die jaws exploded from the support bed thereof.

With reference now also to FIG. 3, the sliding rails 24 on the support bed 12 are T-shaped and receivable and slidable along correspondingly T-shaped grooves 26 defined in each of the first and second die jaws 14, 16.

It will be appreciated that in an alternative embodiment, the rails 24 and rail grooves 26 could be located, instead of on the support bed 12 and the die jaws 14, 16 respectively, on the die jaws 14, 16 and the support bed 12 respectively. Also, the rails 24 and the rail grooves 26 need not be T-shaped.

Although it is apparent from the accompanying illustrations that the die jaws 14, 16 are slidably movable relative to the support bed 12 along the rails 24, a thorough understanding of the internal workings of the modular die tool unit 10 is required to grasp how such sliding movement is attained.

Figure 4:
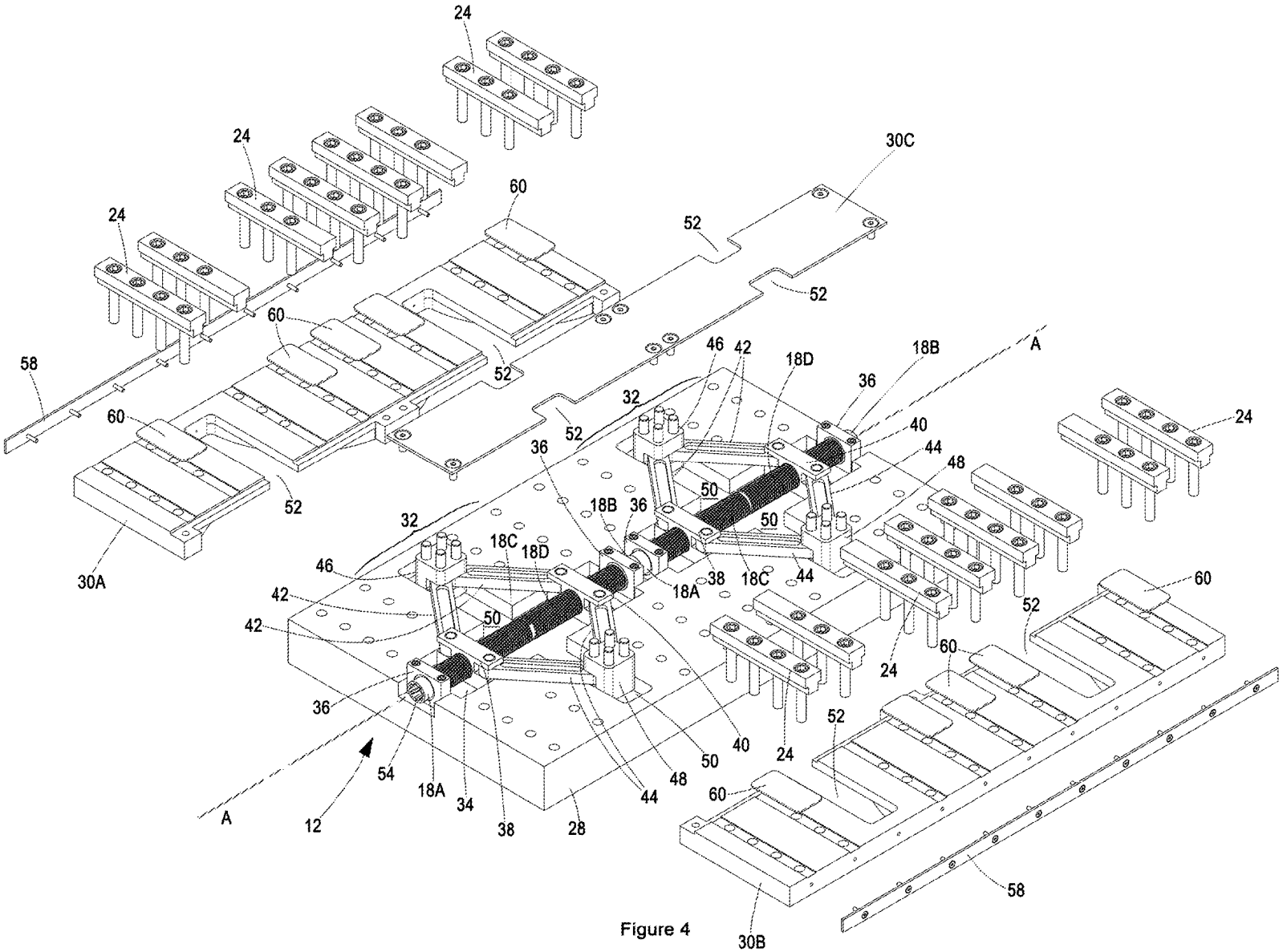
FIG. 4 is an exploded perspective view of the support bed of the modular die tool unit.

FIG. 4 depicts an exploded view of the support bed 12, which support bed 12 comprises a base member 28 and a cover member 30, the cover member 30 being made up from a pair of flanking cover members 30A, 30B and a central cover member 30C.

The cover members 30A, 30B, 30C are mountable over the base member 28 so as to substantially house and/or enclose the one or more drive shafts 18 and their associated translating means 32 there between, the latter to be described in detail hereinafter.

Figure 5:
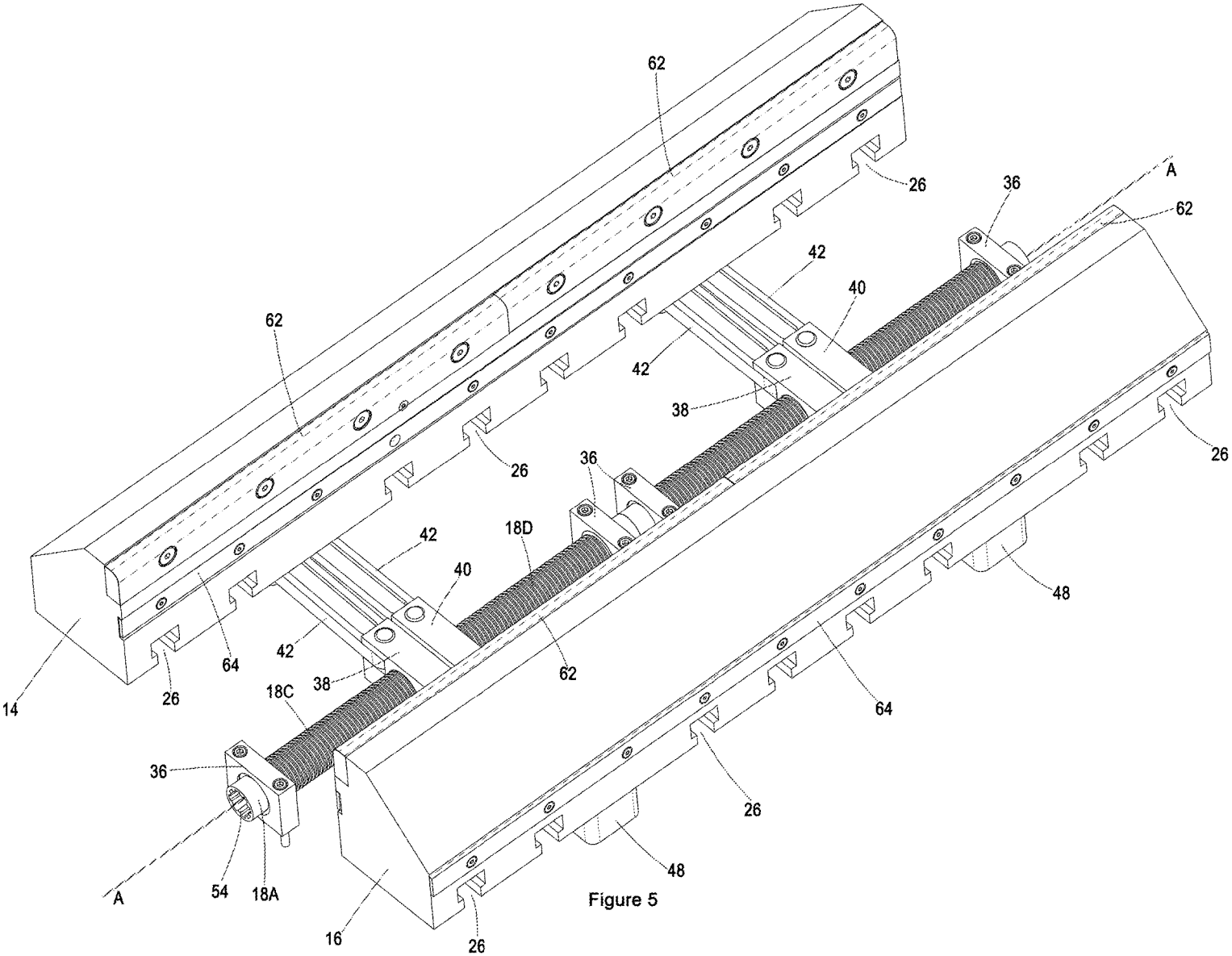
FIG. 5 is a perspective view of the moving components of the modular die tool unit of FIG. 1 with the die jaws in a spaced condition relative to one another.
Figure 6:
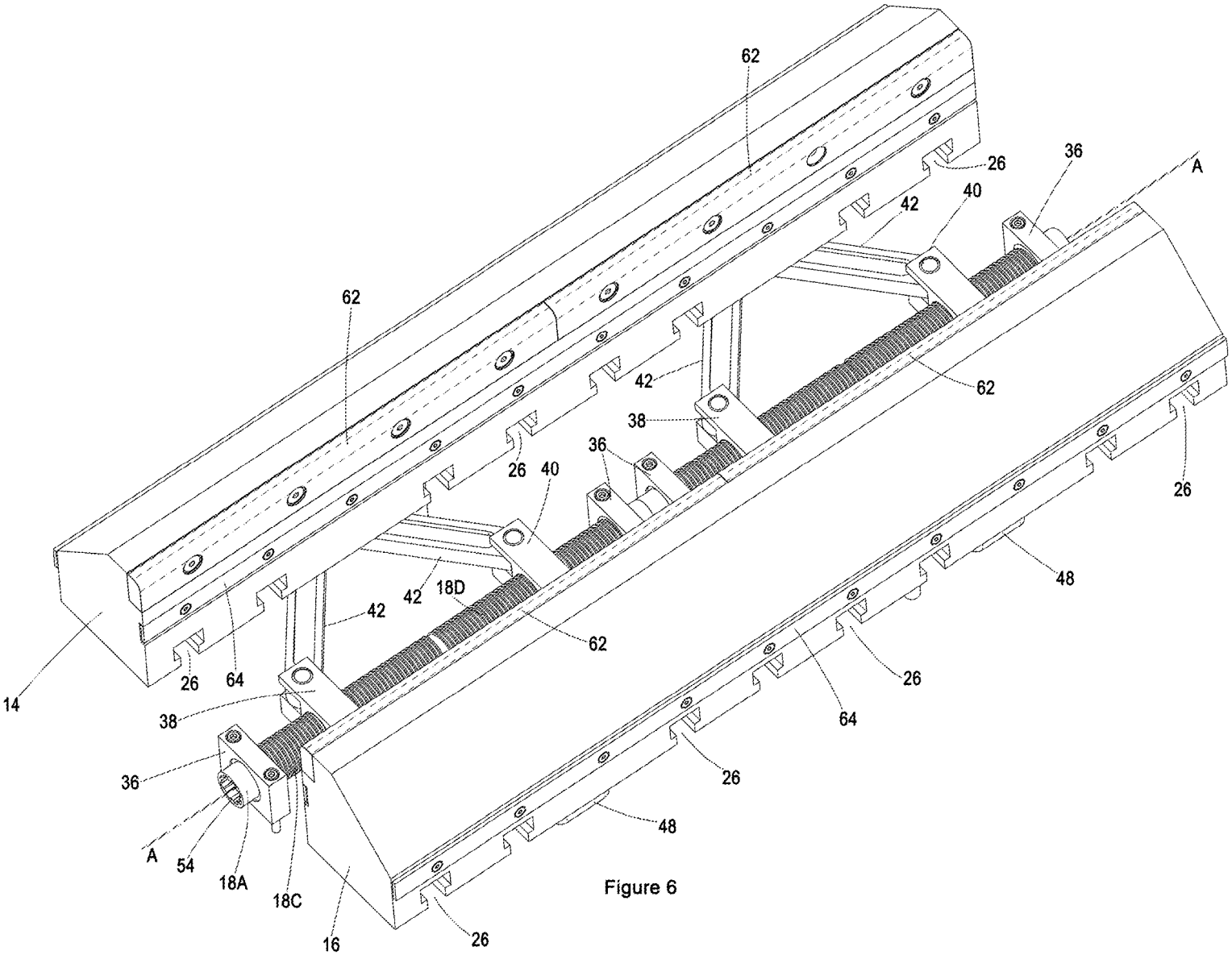
FIG. 6 is a perspective view of the moving components of the modular die tool unit of FIG. 1 with the die jaws moving towards one another.
Figure 7:
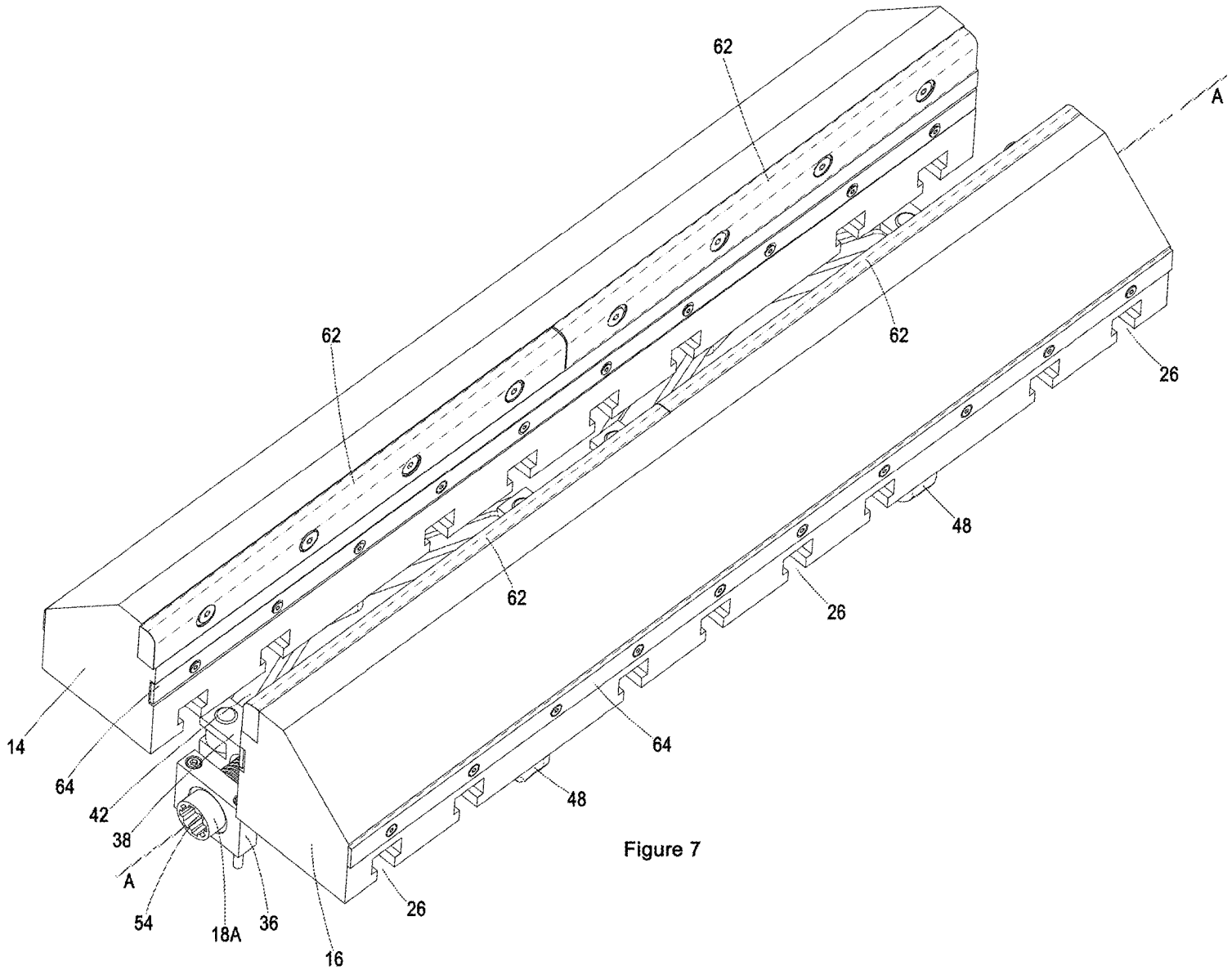
FIG. 7 is a perspective view of the moving components of the modular die tool unit of FIG. 1 with the die jaws moved even closer to one another.

Each drive shaft 18 has opposing first and second longitudinal ends 18A, 18B and a central longitudinal axis A-A extending there through about which the drive shaft 18 is rotatable and on each side of which the respective first and second die jaws 14, 16 are located as more clearly illustrated in FIGS. 5 to 7.

Furthermore, the drive shafts 18 are each divided longitudinally between a first portion 18C and a second portion 18D. The first portion 18C, typically extending axially from near the first longitudinal end 18A of the drive shaft 18 towards a longitudinal centre thereof, has a left-hand or right-hand thread defined there along.

The second portion 18D, typically extending axially from near the second longitudinal end 18B of the drive shaft 18 towards the longitudinal centre thereof, has the other of the left-hand or right-hand thread defined there along. In other words, where the first portion 18C has a left-hand thread, the second portion 18D has a right-hand thread, or vice versa.

In the preferred embodiment, the drive shafts 18 are located within an elongate cavity 34 defined in the centre of the base member 28 and rotatably mounted therein on bearing mounts 36.

The translating means 32 on each of the drive shafts 18 is made up of first and second threaded followers 38, 40 that are in the form of a block having a hole threaded correspondingly with the portion 18C, 18D of the drive shaft 18 on which such follower 38, 40 is respectively located.

It will be appreciated then that the first and second threaded followers 38, 40 are movable axially along the drive shaft 18 between first and second condition. In the first condition, rotation of the drive shaft 18 in a first direction (i.e. a clockwise direction) causes the first and second threaded followers 38, 40 to move towards one another as depicted in FIG. 5. In the second condition, rotation of the drive shaft 18 in a second direction (i.e. an anticlockwise direction) causes the first and second threaded followers 38, 40 to move away from one another as depicted in FIGS. 6 and 7.

The translating means 32 is further made up of a pair of primary connecting arms 42 and a pair of secondary connecting arms 44. The primary connecting arms 42 lie on a first side of the central longitudinal axis A-A, each pivotally connected at their respective ends to one of the first or second threaded followers 38, 40 and a first connector block 46, which connector block 46 is fastenable to the first die jaw 14.

Similarly, the secondary connecting arms 44 lie on a second side of the central longitudinal axis A-A, each pivotally connected at their respective ends to one of the first or second threaded followers 38, 40 and a second connector block 48, which connector block 48 is fastenable to the second die jaw 16.

With the components making up the translating means 32 akin to the mechanism used in commonly known scissor jacks, it is apparent that movement of the first and second threaded followers 38, 40 towards the first condition will cause the first and second connector blocks 46, 48 to move away from one another symmetrically about and transversally with respect to the central longitudinal axis A-A.

Conversely, movement of the first and second threaded followers 38, 40 towards the second condition will cause the first and second connector blocks 46, 48 to move towards from one another symmetrically about and transversally with respect to the central longitudinal axis A-A.

With the die jaws 14, 16 fastened to the respective connector blocks 46, 48, it will be appreciated that the movement of the connector blocks 46, 48 is directly transmitted to the die jaws 14, 16.

As such, and with reference to FIG. 5, rotation of the drive shaft 18 in the first direction will cause the threaded followers 38, 40 to move towards the first condition (i.e. towards one another), consequently causing the die jaws 14, 16 to move away from one another symmetrically about and transversally with respect to the central longitudinal axis A-A.

With reference now to FIGS. 6 and 7, rotation of the drive shaft 18 in the second direction will cause the threaded followers 38, 40 to move towards the second condition (i.e. away from one another), consequently causing the die jaws 14, 16 to move towards from one another symmetrically about and transversally with respect to the central longitudinal axis A-A.

In this manner, rotational motion of the drive shaft 18 in the first and second directions is translated into reciprocal sliding motion of the die jaws 14, 16 relative to the support bed 12, such that the desired relative spacing between the die jaws 14, 16 is attainable to bend a work piece loaded (not shown) thereon as required.

Although the die jaws 14, 16 have been illustrated in the accompanying figures as being fastenable to the connector blocks 46, 48, it will be appreciated that the primary and secondary arms 42, 44 may be configured to pivotally connect to the die jaws 14, 16 directly.

Also, the modular die tool unit 10 has been depicted in the accompanying illustrations as having a pair of co-axially connected drive shafts 18. Instead, it will be appreciated that the modular die tool unit 10 could be made up from just a single drive shaft 18 with a single translating means 32, or a single longer drive shaft 18 with any number of translating means 32 spaced there along.

With reference still to FIG. 4, the base member 28 further defines guiding grooves 50 in which the connector blocks 46, 48 slide back-and-forth such that the die jaws 14, 16 slide square and true. The guiding grooves 50 extend from the elongate cavity and transversally away from the central longitudinal axis A-A.

The cover member 30, when mounted over the base member 28, defines a plurality of slots 52, which slots 52 are substantially aligned with the guiding grooves 50 and sized and shaped to allow the connector blocks 46, 48 to slide there along. It is through the slots 52 that the connector blocks 46, 48 can be fastened to the die jaws 14, 16.

One of the most novel aspects of the invention is its modularity and ease by which adjacent modular die tool units 10 can be coupled to one another end-to-end.

With reference to any of the FIGS. 2 to 7, the first and second longitudinal ends 18A, 18B of the drive shafts 18 each define a connecting formation therein, preferably in the form of a spline hole 54 through which the drive shaft 18 are co-axially connectable end-to-end via one or other couplings.

One coupling for example, is a spline-to-spline (or male-to-male spline) coupling, which although not shown, is used to co-axially connect the drive shafts 18 of a single modular die tool unit 10 to one another.

Another coupling is a cog or sprocket coupling 56 as depicted in FIGS. 1 and 2, which coupling 56 comprises a male spline 56A and sprocket 56B. The male spline 56A is sized and shaped to engage the spline hole 54 defined in the drive shafts 18.

With the support beds 12 of adjacently positioned modular die tool units 10 placed end-to-end in abutting contact with one another, the sprockets 56B of the co-axially aligned drive shafts 18 of the adjacent modular die tool units 10 are placed in close proximity with one another. In this position, a double strand transmission chain (also known as a chain coupling) is securable about both sprockets 56B thereby coupling the drive shafts 18 of the adjacent modular die tool units 10 end-to-end to form a coupled die tool.

It will be appreciated that reference to the term "coupled die tool" will be understood to mean a plurality of coupled modular die tool units 10.

The advantages of this modular configuration, amongst others, are as follows:

1. a coupled die tool of varying length is attainable to suit bed lengths of differently sized press brake machines;
2. a single drive means is capable of being coupled to one end of a coupled die tool to drive all coupled modular die tool units 10 making up such coupled die tool; and
3. any one modular die tool unit 10 can be easily added or removed from the coupled die tool by sliding such modular die tool unit 10 in or out without first having to space the modular die tool units 10 axially relative to one another.

With reference to FIG. 4, the support bed 12 further includes bracing members 58 that may be secured between adjacent modular die tool units 10 of a coupled die tool in a staggered fashion thereby to brace the coupled die tool together.

Furthermore, a plurality of friction reducing members 60 are positioned between adjacent rails 24, and sandwiched between the die jaws 14, 16 and the support bed 12, thereby to reduce the force of friction operably acting between the die jaws 14, 16 and the support bed 12 arising from the relative sliding of the die jaws 14, 16 relative to the support bed 12.

Figure 8:
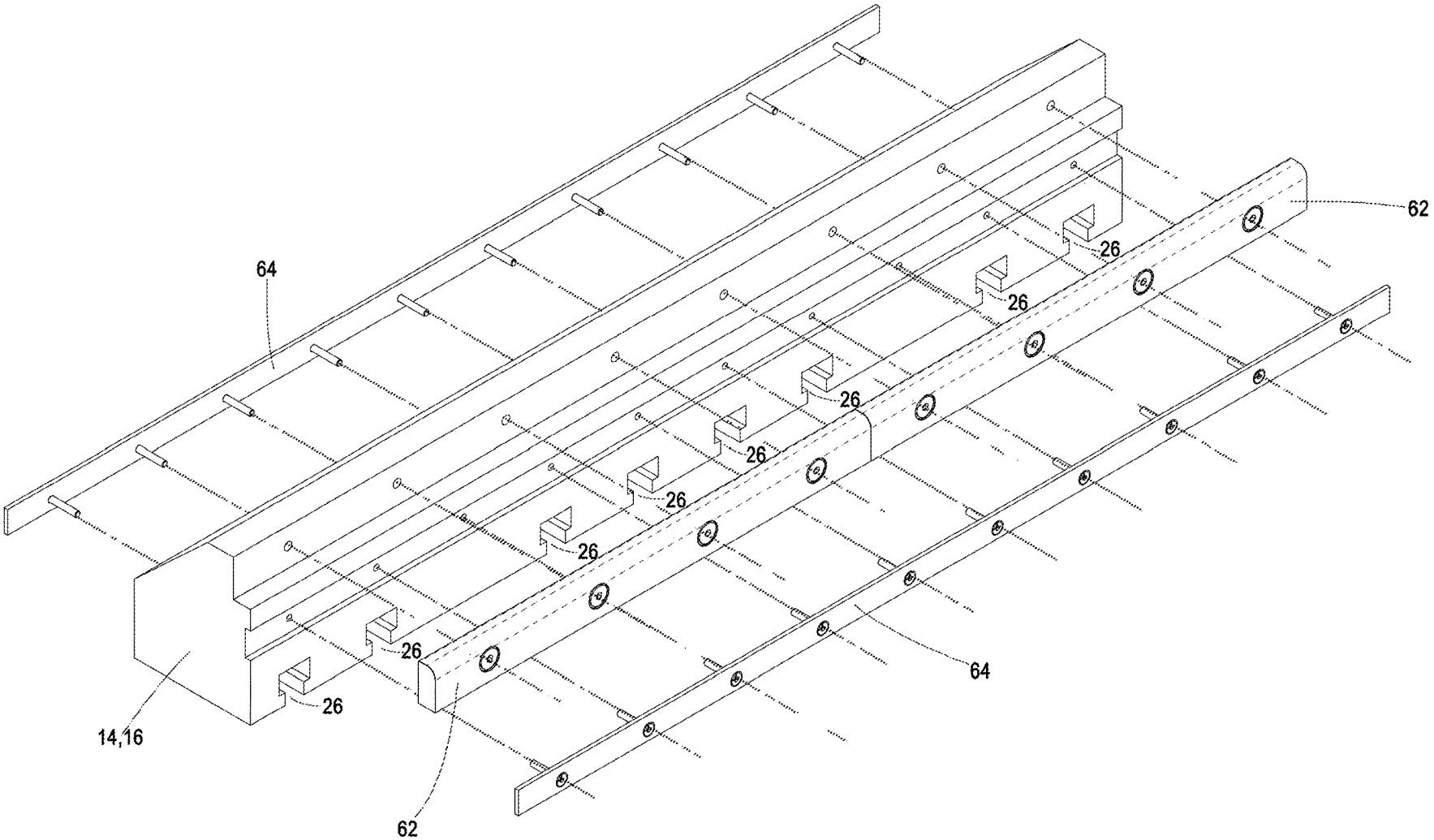
FIG. 8 is an exploded perspective view of the die jaw of the modular die tool unit.

With reference to FIG. 8, depicting one of the die jaws 14, 16, the die jaws 14, 16 each comprise contact inserts 62 along which the work piece operably to be bent comes into contact with the modular die tool unit 10. The contact inserts 62 are removably fastenable to the die jaws 14, 16 such that they may be changed out if worn or if a different bend characteristic is required.

Furthermore, the die jaws 14, 16 also have one or more bracing members 64 that may be secured between die jaws 14, 16 of adjacent modular die tool units 10 of a coupled die tool in a staggered fashion thereby to brace the die jaws 14, 16 of the coupled die tool together, and aiding the die jaws 14, 16 to move in unison.

Although the invention has been described above with reference to preferred embodiments, it will be appreciated that many modifications or variations of the invention are possible without departing from the spirit or scope of the invention.

For example, the connecting formation 54 may take many different forms, i.e. male splines connectable through engagement with a splined sleeve coupling or castellated connecting formations directly or indirectly engageable with one another.

Figure 9:
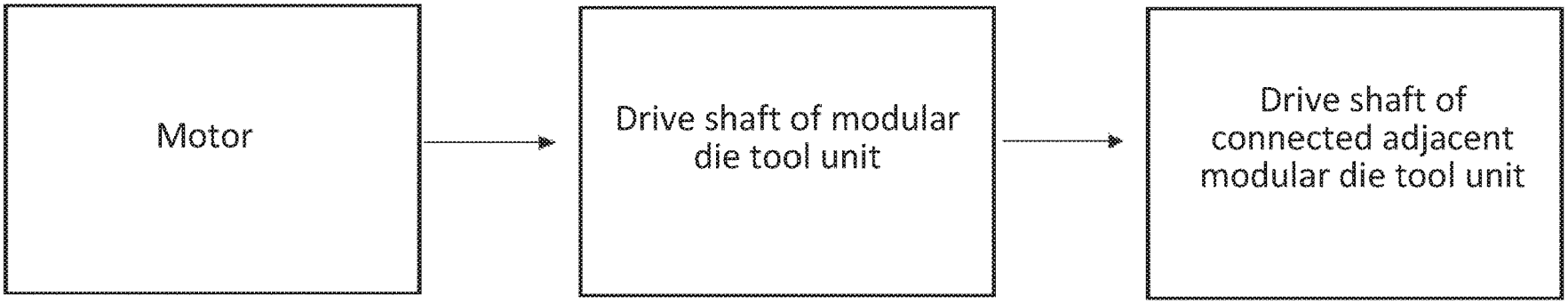
FIG. 9 is a schematic illustration of a modular die tool nit in accordance with the present invention.

Furthermore, the drive means may be manual or automated. An example automated drive means is a motor, as schematically illustrated in FIG. 9. The use of such a motor to drive the drive shafts of one or more die tool units in a press brake is well known in the art, as described, for example, in U.S. Pat. No. 5,305,659, herein incorporated by reference. A manual drive means may be effectuated by manually manipulating the one or more drive shafts either directly or indirectly through a handle or crank, as is well known in the art.

The invention claimed is:

1. A modular die tool unit for a press brake including:

a drive shaft having opposing first and second longitudinal ends and a central longitudinal axis extending there through about which the drive shaft is rotatable, wherein the drive shaft is divided longitudinally between a first portion, having a left-hand or right-hand thread defined there along, and a second portion, having the other of the left-hand or right-hand thread defined there along, the first portion and the second portion being located nearer the first and the second longitudinal ends of the drive shaft respectively;

a pair of first and second die jaws each located on opposite sides of the central longitudinal axis, the die jaws being reciprocally movable towards and away from one another relative to the central longitudinal axis;

a translating means for translating the rotational motion of the drive shaft into the reciprocal motion of the die jaws; and a connecting formation at each of the longitudinal ends of the drive shaft for at least one of:

(i) coaxially connecting to adjacent drive shafts of one or more adjacent modular die tool units so as to connect such drive shafts end-to-end; and (ii) connecting a drive means to the drive shaft of the modular die tool unit, or to the adjacent drive shafts of the one or more adjacent modular die tool units, thereby to drive rotation of the drive shafts;

characterized in that the translating means includes:

first and second threaded followers located respectively on the first and the second portions for the drive shaft and movable axially there along between a first condition, wherein rotation of the drive shaft in a first direction causes the first and second threaded followers to move towards one another, and a second condition, wherein rotation of the drive shaft in a second direction causes the first and second threaded followers to move away from one another;

a pair of primary connecting anus located on one side of the central longitudinal axis, the primary connecting arms each having a first end pivotally connected to one of the respective first or second threaded followers and a second end pivotally connectable to the first die jaw; and a pair of secondary connecting aims located on a side of the central longitudinal axis opposite to the side on which the primary connecting arms are located, the secondary connecting arms each having a first end pivotally connected to one of the respective first or second threaded followers and a second end pivotally connectable to the second die jaw;

such that movement of the first and second threaded followers towards the:

(i) first condition causes the die jaws to move away from one another; and (ii) second condition causes the die jaws to move towards one another, wherein the movement of the die jaws is transversal to and symmetrical with respect to the central longitudinal axis of the drive shaft.

2. A modular die tool unit according to claim 1, wherein the connecting formation at each of the longitudinal ends of the drive shaft is a castellated connecting formation, the castellated connecting formations of co-axially connectable drive shafts being engageable directly or through an intermediary member.

3. A modular die tool unit according to claim 1, wherein the connecting formation at the first longitudinal end of the drive shaft is a first male spline formation and at the second longitudinal end of the drive shaft is a spline hole for receiving a second male spline formation of the adjacent drive shaft therein.

4. A modular die tool unit according to claim 1, wherein the connecting formation at each of the first and the second longitudinal ends of the drive shaft is: (i) a male spline formation; or (ii) a female spline formation; having a coupling connectable respectively thereon or therein for connecting at least one of the drive means thereto and the adjacent drive shafts of adjacent modular die tool units together.

5. A modular die tool unit according to claim 4, wherein the coupling is from a group of couplings including:

(i) a sleeve coupling defining at opposing ends thereof spline holes for receiving the male spline formations of the adjacent drive shafts therein;

(ii) a spline-to-spline coupling defining at opposing ends thereof male spline formations insertable into the spline holes of the adjacent drive shafts; and (iii) a cog coupling having thereon either a male spline formation or a spline hole for engaging the drive shaft, and a cog for engaging at least one of: (i) the cog on the drive shaft of an adjacent modular die tool unit; and/or (ii) the drive means for rotating the drive shaft.

6. A modular die tool unit according to claim 5, wherein the cog;

is a gear and further wherein a gearing set transmits drive: (i) from the drive means to the drive shafts; or (ii) between co-axially connected drive shafts of adjacent modular die tool unit; or is a sprocket and further wherein a transmission chain transmits drive: (i) from the drive means to the drive shafts; or (ii) between co-axially connected drive shafts of adjacent modular die tool unit, wherein the movement of the die jaws is transversal to and symmetrical with respect to the longitudinal central axis of the drive shaft.

7. A modular die tool unit according to claim 6, wherein the translating means further includes first and second connectors connected between the respective first and second die jaws and the second ends of the primary and secondary connecting arms, the second ends of the primary and secondary connecting arms being pivotally connected to the first and second connectors.

8. A modular die tool unit according to claim 7, wherein the first and second connectors are connector blocks pivotally connected to the second ends of the respective connecting anus and fastened to the respective first or second die jaws such that movement of the first and second threaded followers towards the:

(i) first condition, causes the first and second connector blocks, and consequently the first and second die jaws respectively connected thereto, to move away from one another; and (ii) second condition, causes the first and second connector blocks, and consequently the first and second die jaws respectively connected thereto, to move towards from one another.

9. A modular die tool unit according to claim 8 including a support bed on which the drive shaft is supported, the support bed and the die jaws having correspondingly engageable sliding formations along which the die jaws are slidable relative to the support bed.

10. A modular die tool unit according to claim 9, wherein the correspondingly engageable sliding formations is a plurality of rails projecting outwardly from the support bed or the die jaws, and a plurality of rail grooves defined in the other of the support bed or the die jaws, the rails being receivable and slidable within the rail grooves.

11. A modular die tool unit according to claim 10, wherein the support bed is made up of a base member and a cover member mountable over the base member thereby to substantially enclose the drive shaft and the translating means therebetween, the drive shaft being rotatably mountable on the base member on at least a pair of spaced apart bush or bearing mounts.

12. A modular die tool unit according to claim 11, wherein the rails are T-shaped rails projecting outwardly from the cover member of the support bed and the rail grooves are T-shaped rail grooves defined in the die jaws, the T-shaped rails being slidably engageably with the T-shaped rail grooves, and further wherein at least the cover member of the support bed defines slots therein along which the first and second connector blocks are movable and through which such connector blocks are fastenable to the respective first and second die jaws.

13. A modular die tool unit according to claim 12, wherein the support bed houses two drive shafts connected end-to-end with each drive shaft having an independent translating means such that each of the first and second die jaws is movably supported on two respective first and second connector blocks.

14. A modular die tool unit according to claim 13, wherein each die jaw comprises one or more contact inserts along which a work piece to be operably bent by the press brake comes into contact with the modular die tool unit, the contact inserts being removably fastenable to the die jaws.

15. A modular die tool unit according to claim 14, wherein one or more bracing members are removably fastenable between at least one of the die jaws and the one or more adjacent modular die tool units in a staggered fashion.

16. A modular die tool unit according to claim 15 including one or more friction reducing members positioned between adjacent rails, and sandwiched between the die jaws and the support bed, thereby to reduce the force of friction operably acting between the die jaws and the support bed arising from the relative sliding of the die jaws relative to the support bed.

17. A modular die tool unit according to claim 16 including a central guard and a pair of flanking guards for covering the rails regardless of the position of the die jaws on the support bed, the central guard is connected across operatively inner sides of the first and the second die jaws, with each of the flanking guards connected across an operatively outer side of the respective first or second die jaw and an operatively outer side of the support bed.

* * * * *